US006053254A

United States Patent [19]

Gano

[11] Patent Number: 6,053,254

[45] Date of Patent: Apr. 25, 2000

[54] METHOD AND APPARATUS FOR PROVIDING SELECTIVE WELLBORE ACCESS

[75] Inventor: John C. Gano, Carrollton, Tex.

[73] Assignee: Halliburton Energy Services, Inc., Houston, Tex.

[21] Appl. No.: 09/106,594

[22] Filed: Jun. 29, 1998

[51] Int. Cl.[7] ..... E21B 19/00

[52] U.S. Cl. ..... 166/384; 166/386; 166/117.6; 166/332.4

[58] Field of Search ..... 166/384, 386, 166/50, 117.5, 117.6, 332.4

[56] References Cited

U.S. PATENT DOCUMENTS

| | | | |
|---|---|---|---|
| 2,211,803 | 8/1940 | Warburton . | |
| 5,520,252 | 5/1996 | McNair | 166/313 |
| 5,564,503 | 10/1996 | Longbottom et al. . | |
| 5,730,224 | 3/1998 | Williamson et al. . | |
| 5,735,350 | 4/1998 | Longbottom et al. . | |
| 5,954,134 | 9/1999 | Longbottom | 166/384 X |

*Primary Examiner*—Roger Schoeppel

*Attorney, Agent, or Firm*—Crutsinger & Booth

[57] ABSTRACT

Disclosed is an improved method and apparatus for providing selective access to either a main well or a lateral well extending from the main well. A sleeve assembly installed in the junction of a main and lateral well includes a housing with a side window and a slidable internal sleeve for locating in either an "up" position or a "down" position. When the internal sleeve is "up", the side window is uncovered so that downhole tools select the main wellbore by gravity. When the internal sleeve is "down", it covers the side window and guides downhole tools into the lateral well. When first making a lateral well, the lateral wellbore may be lined through a window in the main wellbore casing and a window opened in the wall of the lateral wellbore liner, in vertical alignment with the main well flow conductor. A sleeve assembly installed in the lateral wellbore liner, proximate the liner window includes a housing with a window and a slidable internal sleeve for locating in either an "up" position or a "down" position. When the internal sleeve is "up", the lateral liner window is uncovered so that downhole tools select the main wellbore by gravity. When the internal sleeve is "down", it covers the lateral liner window and guides downhole tools into the lateral well.

34 Claims, 3 Drawing Sheets

METHOD AND APPARATUS FOR PROVIDING SELECTIVE WELLBORE ACCESS

TECHNICAL FIELD

The present invention relates to the field of well drilling and completion and more particularly, to methods and apparatus for drilling and completion of branching or multilateral wells with provisions for connectivity and isolation between the branching wellbores.

BACKGROUND OF THE INVENTIONS

Although horizontal or lateral wells are well known in the art, horizontal well drilling and production have not been significant aspects of the industry until recently. Even though horizontal drilling is much more expensive than conventional vertical drilling, well production can be increased greatly when it is used appropriately. In general, productivity must be more or less tripled to justify the increased cost of a horizontal well. In the case of naturally fractured reservoirs and thin reservoirs, production can be increased tenfold or more, so that relative cost is not a deterrent to horizontal drilling. In many situations, the horizontal well is drilled as a lateral from a main vertical wellbore. This is an especially common practice on offshore platforms, where the increased production of a lateral well, or multilateral wells, allows a field to be developed with fewer platforms.

As a result of the increased usage of lateral wells, lateral and multi-lateral well completion and subsequent production and servicing have become an important concern. Well service operations require the ability to selectively reenter, or access subterranean wellbores to perform completion or well servicing work. It is desirable and cost effective for the system to be such that the selected wellbore can be accessed with a coiled tubing or wireline rig, so that the a full drilling rig is not required. Furthermore, it is desirable to minimize the number of trips required to access and work a selected lateral wellbore, the more cost effective a lateral well completion system will be. For example, U.S. Pat. No. 2,211,803, issued Aug. 20, 1940 to W. A. Warburton describes a selective access system, which requires multiple trips to install and remove a sleeve to selectively block access to a bore.

Only recently has the ability to access one or more lateral wellbores from a main wellbore become important within the exploration industry and present prior art devices do not address this need. Prior art multilateral wellbore completion systems presently employ sliding sleeves to open and close small ports specifically designed for circulation and production control purposes but not for providing tool access into a lateral wellbore. Consequently, these systems are ineffective for the more recent problems of completion, production and work-over of a wellbore with one or more lateral wellbores.

Therefore, the first object of the present invention is to provide an apparatus and method for main and multilateral wellbore completion and production with access capability for tools into any selected wellbore. A second object is that this system has the ability to provide connectivity and isolation as described above, so that structurally sound, hydraulically sealed junctures can be made between main and lateral wellbores. A third object is to provide tool access to such a system by coiled tubing or wireline rigs, so that the services of a full drilling rig will not be required. Yet another object is to minimize the number of trips required to access and work a selected lateral wellbore.

SUMMARY OF THE INVENTIONS

The present inventions contemplate improved methods and apparatus for providing main and multilateral wellbore completion and production, with access capability for tools into any selected wellbore, by providing gravity selection for main wellbore access and sliding sleeve selection for lateral wellbore access. Practice of the present inventions include some steps and apparatus well known in the oil field arts, and aspects previously discussed in pending U.S. application Ser. number 08/731,464, filed Oct. 15, 1996 now U.S. Pat. No. 5,735,350, the content of which is included herein by reference.

In the present inventions, a whipstock with a drillable center is set at the desired location for the planned lateral, a window is milled in the main wellbore casing and the lateral wellbore is drilled in accordance with the prior art. A liner for the lateral wellbore is set through the window, with a casing hanger above the window and the juncture is cemented. After completing the lateral wellbore, a smaller whipstock, referred to as a mill guide, is set in the lateral to guide a mill on a vertical path along the center of the main well bore. This operation makes a window in the liner and an opening through the drillable center whipstock for access to the main well. After this operation is complete, the smaller whipstock is pulled. Then an access sleeve housing, with a side window matching the liner window and an internal, two position, access selection sleeve is fitted into the liner. When the access selection sleeve is pulled up to a first position within the access sleeve housing, tools pass vertically downhole through its length and through the matching windows to access the main well in a gravity selection. When the access control sleeve is pushed down, to a second position, the matching windows are covered and tools are guided by the access selection sleeve directly into the lateral well.

Thus, the apparatus and method of the present invention provide direct, reliable main wellbore access downhole from the lateral wellbore as required when the matching windows are "opened" by pulling the access control sleeve to the "up" position so that the main wellbore is naturally selected and accessed by gravity. Positioning the access control sleeve includes the step of engaging a selective profile associated with the sleeve. In a preferred embodiment, there are two such profiles associated with the access control sleeve, a pushing profile for selecting lateral wellbore access and a pulling profile for selecting main wellbore access. In other embodiments, the step of positioning the access control sleeve for selective access may be accomplished by any of a number of mechanical, hydraulic or electrical systems.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
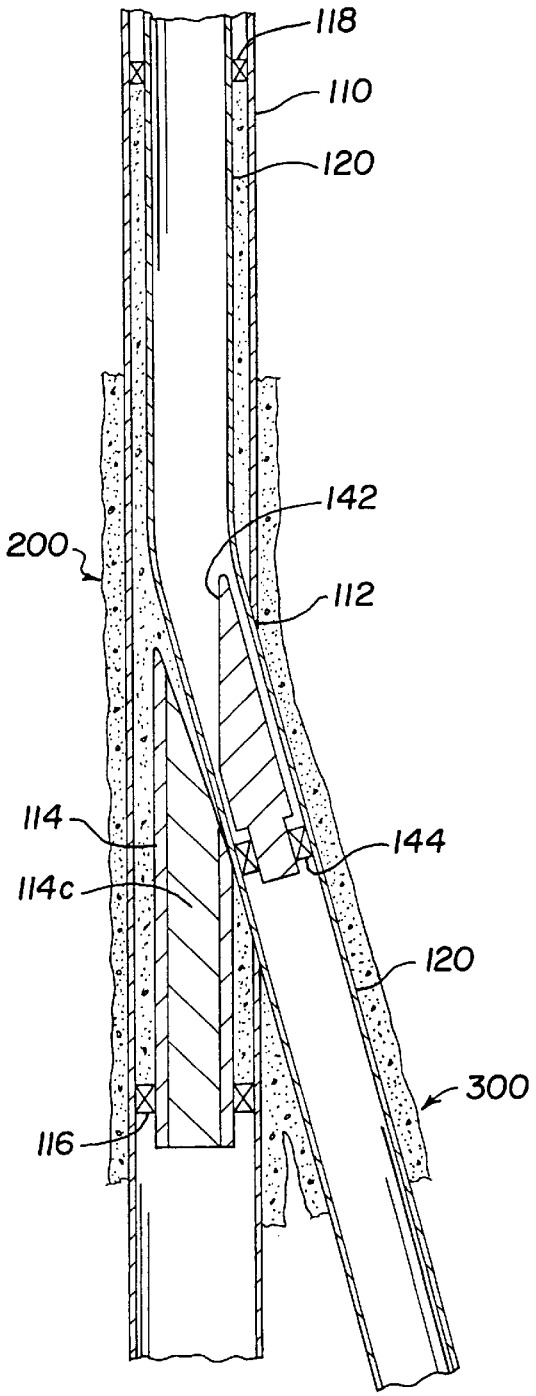
FIG. 1 is a vertical section view showing a lateral wellbore configuration as prepared for opening a window in the lateral liner.
Figure 3:
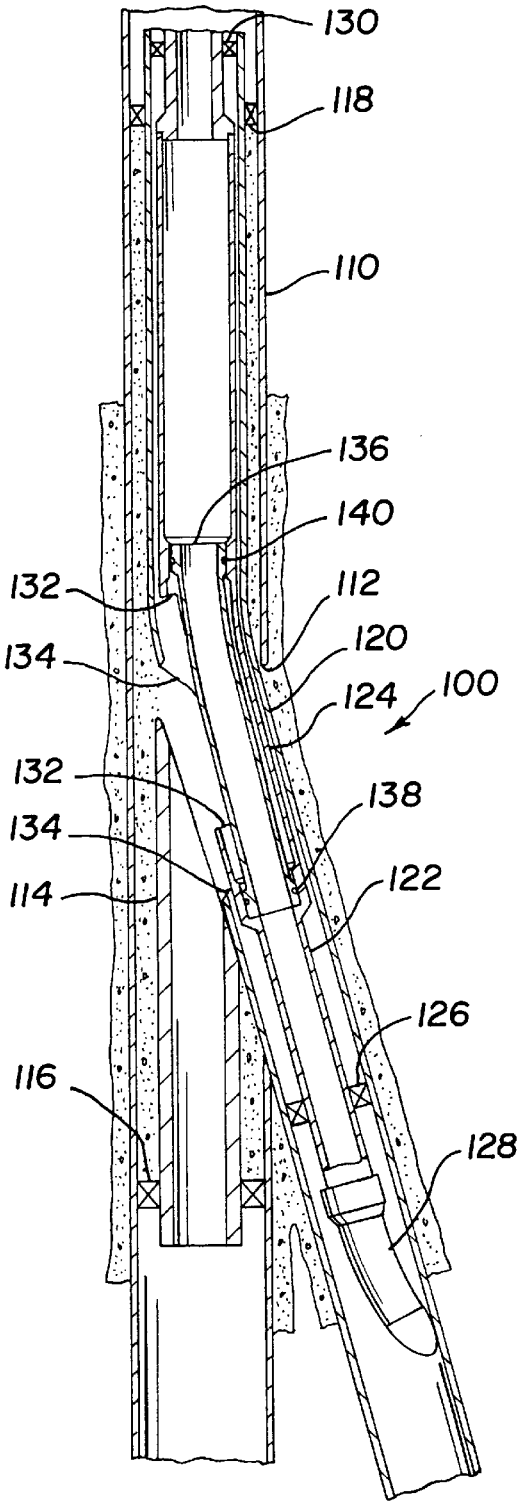
FIG. 3 is a vertical section view of a lateral wellbore wherein the access control sleeve assembly is configured for selection of a lateral wellbore.
Figure 4:
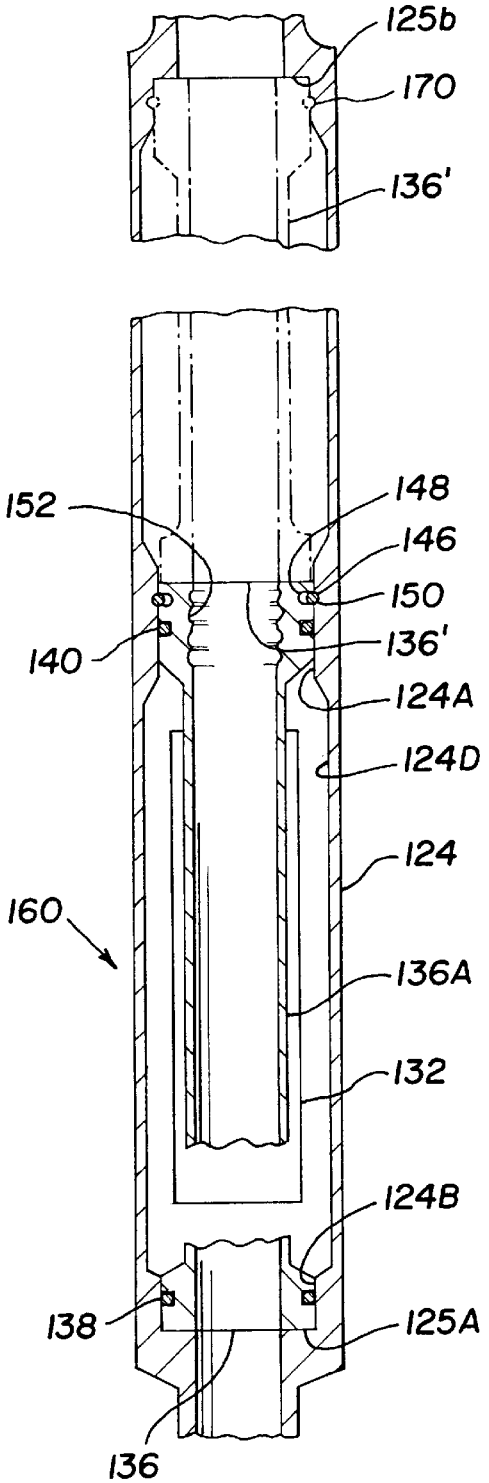
FIG. 4 is a vertical section view of the access control sleeve assembly of the present invention.

The present inventions are described in the following by referring to drawings of examples of how the inventions can be made and used. In these drawings, reference characters are used throughout the several views to indicate like or corresponding parts. FIG. 1 illustrates a well with a subterranean main and lateral bore intersection wherein the methods and apparatus of the present inventions are to be applied. The details of these methods and apparatus are illustrated in FIGS. 2–4.

The terms lateral and main are used herein to identify subterranean intersecting or branching wellbores. Although these terms are used in a variety of ways in the art, as used herein "main" is defined as that well or bore which for whatever reason tools and other devices will ordinarily enter at the subterranean intersection. In other words, tools will be more likely to enter the main well or bore at the intersection. A "lateral" is a well or bore, which tools and other devices ordinarily will not enter. In other words, tools will be less likely to enter the lateral well or bore at the intersection. The ordinary selection of or entrance into the main well or bore by tools could be caused by gravitational forces or bore orientation, location, size, or the like. The modifiers "lateral" and "main" are not intended or used to identify which bore or well was formed first or which has more or less horizontal or vertical orientation. To the extent that the industry may ascribe a different, broader, or narrower meaning to these terms, it is not intended for this application.

In FIG. 1, main wellbore casing 110 is set in primary wellbore 200. Whipstock 114 is set on whipstock packer 116 at a location and orientation for use in creating a window 112 in a side wall of casing 110. Preferably, whipstock 114 has a soft, drillable core 114C for purposes to be described later. Lateral liner 120 hangs from liner hanger 118 and extends through window 112 into lateral wellbore 300 and the well juncture has been sealed, preferably by using a cementitious material by one of many processes well known to those skilled in the art. A second whipstock or mill guide 142 has been set in lateral liner 120 where it is positioned and held by whipstock packer 144. Preferably, whipstock 142 has been set after completion work in lateral wellbore 300 is substantially complete. Whipstock 142 is located and oriented to guide a conventional mill or mills (not shown) along the central axis of main wellbore casing 110 so as to create a window in a side wall of lateral liner 120.

Figure 2:
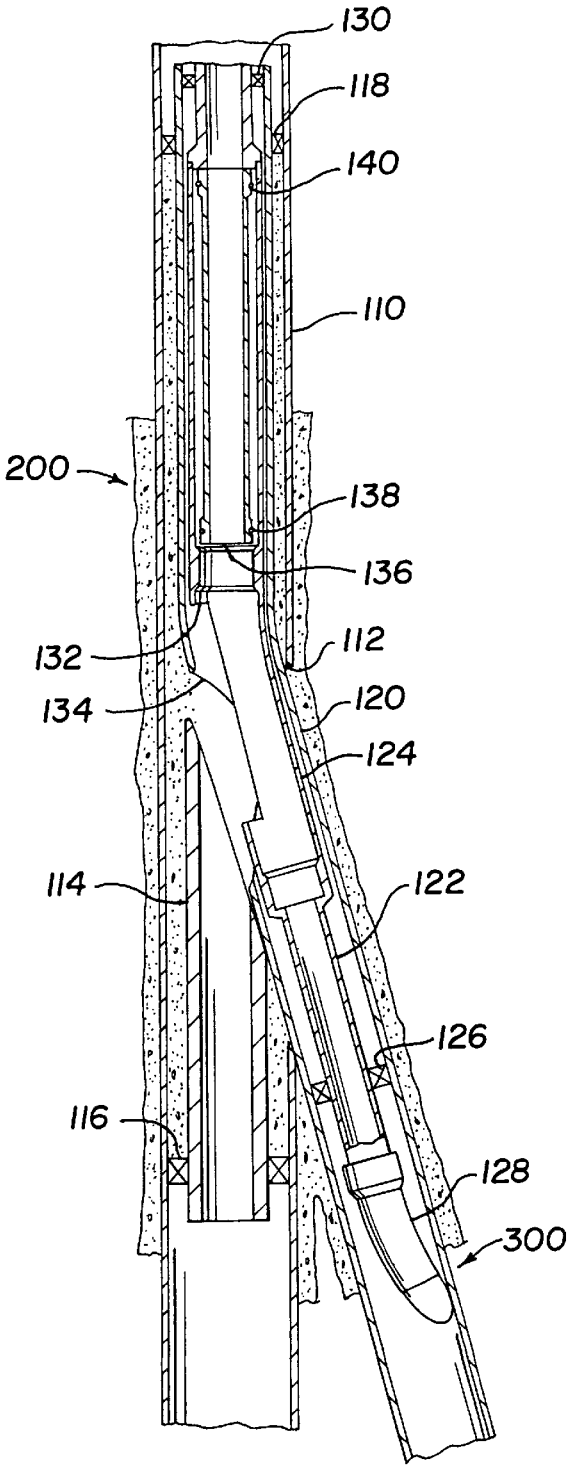
FIG. 2 is a vertical section view of a lateral wellbore wherein the access control sleeve assembly is configured for gravity selection of the main wellbore.

In FIG. 2, it is seen that window 134, in alignment with main wellbore casing 110 and whipstock 114, has been created in the side wall of lateral liner 120 and that drillable core 114C has been removed by milling to leave an open center or passageway. The subsequent removal of mill guide 142 and enlargement of the window allows installation of the present inventions to be completed. Bent deflector 128, assembled on the leading end of completion tubing 122, scrubs along the inside wall of liner 120 as it is run into the hole so as not to pass through window 134. Instead, deflector 128 follows lateral liner 120 into the lateral well 300. Sleeve assembly 160 is positioned within lateral liner 120 and includes a housing 124 packed off in tubing 120 by top packer 130 and completion tube packer 126. Access sleeve housing 124 includes a window 132, proximate to and aligned with lateral liner window 134, and of substantially equal overall size to allow tool passage therethrough.

Access selector sleeve 136 is mounted to axially slide in housing 124. In FIG. 2, sleeve 136 is shown in an "up" position, wherein it is above access sleeve window 112 so that tool passage through aligned windows 132 and 134 is unobstructed. Thus, when access selector sleeve 136 is in this position, coiled tubing or wireline tools fit with suitable flexible couplings that are run downhole will select the main wellbore under the influence of gravity. Seal rings 138 and 140, on access selector sleeve 136, are not called upon to provide sealing in this position shown, and are preferably dimensioned to be lightly loaded or out-of-contact.

FIG. 3 shows the sleeve assembly installation of FIG. 2, with access selector sleeve 136 shifted into a "down" position. In FIG. 3 the aligned windows 132 and 134 are closed to provide access to the lateral well. Coiled tubing tools that are run downhole with access selector sleeve 136 in this position will be reliably guided into the lateral well completion tube. In this position, seal rings 138 and 140 are in sealing contact with the inner wall of access sleeve housing.

FIG. 4 is a detailed view of one embodiment of the access sleeve housing 124 and access selector sleeve 136. Access selector sleeve 136 is shown in the "downhole" position moved axially against shoulder 125A closing sleeve housing window 132 so as to provide guided access to lateral wellbore 300. Shoulder 125A provides a stop to limit travel of sleeve 136 in housing 124. Alternatively, access selector sleeve 136', shown in phantom lines, is in the "uphole" position moved axially against shoulder 125B, wherein sleeve housing window 132 is unobstructed or "open." Shoulder 125B provides a stop to limit travel of sleeve 136 in housing 124. It is envisioned that other forms of mechanical stops could be used such as pins, snap rings and the like to confine the travel of sleeve 136 and to provide positive locator stops and to prevent the sleeve's inadvertent dislodgment from the housing. Access sleeve housing 124 has an enlarged internal diameter 124D except at areas contacted for sealing by seal rings 138 and 140. Additionally, the internal diameter at sealing area 124B, where sealing contact is made by seal ring 138, preferably is slightly smaller than the internal diameter at sealing area 124A, where sealing contact is made by seal ring 140. The internal clearance provided between access selector sleeve 136 and the internal diameters of access sleeve housing 124A permit free movement of access selector sleeve 136 between "up" and "down" positions. The width of access sleeve housing window 132 is less than the internal diameter of sealing area 124B, so there is no possibility of losing access selector sleeve 136 as it moves across its opening. Other methods for guiding the sleeve such as mating pins and slots or the like can be used.

A releasable position lock or latch for sleeve 136 is provided by detent spring 146. Spring 146 is a discontinuous ring mounted in retaining groove 148. Detent spring 146 is compressed by the diameter of sealing area 124A and will expand to engage the lower position detent groove 150. In a similar manner, sleeve 136 is retained in the "up" position by the upper position detent groove 170. A significant axial force, in the order of 10,000–20,000 pounds, is required to override the retaining force of detent spring 146 when so engaged. Although a ring-groove assembly is shown for latching the sleeve in axial position, other mechanical locking deices could be used.

Various methods and apparatus, well known in the art, may be used to shift access selector sleeve as desired. For example, a tool, with a spring loaded profile, or key, that will only lock into the discreet profile 152, may be used to find and engage access selector sleeve 136. Position may then be shifted by jarring "up" or "down." In an alternative , discreet "down" and "up" (opening and closing) shifter profiles may be provided, together with cams that disengage the tool from the profile at the end of the stroke and engage a position retaining latch. Putting the opening and closing shifter keys at or near the bottom of the tool string gives the ability to shift access selector sleeve 136 to select the lateral well as the tool string is run in, and to return selector sleeve to its original "main well" position as the tool comes out of the hole.

Figure 5:
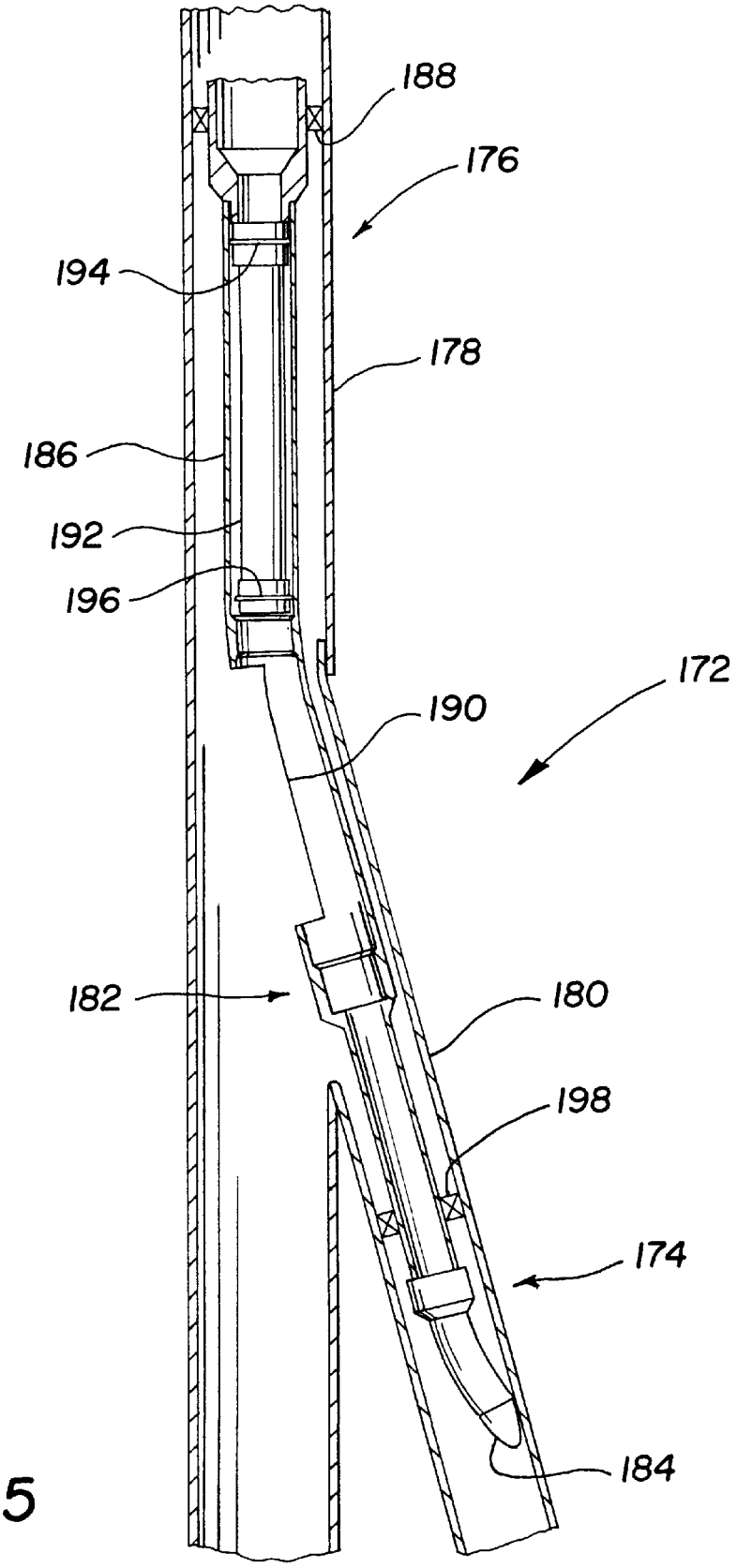
FIG. 5 is a view section to FIG. 1 showing a lateral wellbore configuration with the access control sleeve assembly installed therein.

FIG. 5 shows the present inventions as used to provide selective access to a previously existing lateral well installation 172. Here, lateral well 174, with lateral well liner 180, joins main well 176 with casing 178. Sleeve assembly 182 has been guided into lateral well literal 180 by tail pipe 184, so as to be installed across the wellbore juncture, extending from main well 176 into lateral well 174. Sleeve housing 186 of sleeve assembly 182 is supported at the upper end by casing hanger 188 and sealed off at the lower end, in lateral well 174, by packer 198. Tubular sliding sleeve 192, fitted within sleeve housing 186, is shown in the upper position. In this position, access is provided to the distal portion of main well 176 through alignment of the length of sleeve 192 and the opening of side window 190. Side window 190 is centrally located and vertically aligned with the center of main well 176 so that down hole tools will select main well 176 by gravity. As described in previously discussed embodiments, sliding sleeve 192 may be selectively moved to a second, bottom position, where side window 190 is covered, so as to close off access to main well 176 and sliding sleeve 192 is aligned to direct downhole tools to lateral well 174. In this bottom position, sleeve seals 194 and 196 engage sleeve housing 186, in the manner shown in FIG. 4, so that pressure in lateral well 174 is isolated from main well 176.

The embodiments shown and described above are exemplary. Many details are well known in the art and, therefore, are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. A method for selectively accessing a lateral bore or main bore comprising the steps of:

providing a sleeve assembly with a side window and a slidable internal sleeve;

positioning the sleeve assembly within the lateral bore so that the side window is central to and aligned with the main bore;

sliding the internal sleeve to a first position in the assembly, wherein the window is open and access is provided to the main bore; and sliding the internal sleeve to a second position wherein the window is closed and access is provided to the lateral bore.

2. The method of claim 1 additionally comprising;

lining the lateral bore with a liner that extends into the main bore;

creating a second window through the sidewall of the liner, the window being central to, and axially aligned with the main bore; and positioning the sleeve assembly within the liner, the sleeve being movable between a first position wherein the second window is closed, so that downhole tools are guided into the lateral bore, and a second position, wherein the second window is unobstructed, so that downhole tools select the main bore by gravity.

3. The method of claim 2 and further comprising the step of cementing the liner in place within the lateral bore, the step of cementing creating a pressure seal between the window and the liner.

4. The method of claim 3 wherein the step of cementing further comprises injecting the cement into the annular space between a main well flow conductor and a wall of the main bore.

5. The method of claim 1 comprising providing first and second stops in the sleeve assembly to locate the sleeve at the first and second positions.

6. The method of claim 5 wherein the stops comprise shoulders on the sleeve assembly.

7. The method of claim 1 additionally comprising the steps of releasably latching the sleeve in the first position when the sleeve is moved to the first position and releasably latching the sleeve in the second position when the sleeve is moved to the second position.

8. A method for selectively accessing a lined lateral bore or a lined main bore comprising the steps of:

setting a lateral bore liner, the lateral bore liner internally engaging the main well uphole from the lateral bore and extending into the lateral bore;

opening a first window vertically through a sidewall of the lateral bore liner and in alignment with the main bore liner;

setting a sleeve housing in the lateral bore liner, the sleeve housing having a second window corresponding to the first window;

aligning the second window with the first window; and selectively positioning a slidable access selector sleeve within the sleeve housing, so that, in a first position the aligned windows are closed thereby providing access to the lateral bore liner and, in a second position, the aligned windows are open providing access to the main bore liner.

9. The method of claim 8 further comprising the step of cementing the main bore lines in place within the lateral bore, the step of cementing creating a pressure-bearing seal around the main bore lines.

10. The method of claim 8 additionally comprising providing first and second stops in a sleeve assembly to locate the sleeve at the first and second positions.

11. The method of claim 10 wherein the stops comprise shoulders on the sleeve assembly.

12. The method of claim 8 additionally comprising the steps of releasably latching the sleeve in the first position when the sleeve is moved to the first position and releasably latching the sleeve in the second position when the sleeve is moved to the second position.

13. An apparatus for providing selective downhole tool access to a lateral bore or main bore comprising:

a sleeve assembly extending from within the main bore to within the lateral bore, the sleeve assembly comprising a sleeve movable between a first position wherein the main bore is closed and the sleeve assembly opens into the lateral bore, and a second position wherein the sleeve assembly is open into the main bore and downhole tools select the main bore by gravity.

14. An apparatus according to claim 13 wherein the sleeve assembly additionally comprises a selectively openable side window central to, and vertically aligned with, the main bore.

15. An apparatus according to claim 14 wherein the sleeve assembly further comprises an access selector sleeve proximate to and covering the side window, so as to direct downhole tool access to a distal portion of the lateral bore.

16. An apparatus according to claim 14 and further comprising:

a slidable access selector sleeve proximate the side window, the access selector sleeve being movable within the sleeve assembly to open the side window and thereby allow access to a distal portion of the main bore.

17. An apparatus according to claim 13 wherein the sleeve assembly further comprises:

a sleeve housing including a side window located centrally to and vertically aligned with the main bore; and a slidable access selector sleeve movable within the sleeve housing between the first position and the second position.

18. An apparatus according to claim 17 additionally comprising stops provided on the sleeve housing positioned to engage the sleeve when in the first and second positions to retain the sleeve in the sleeve housing.

19. An apparatus according to claim 18 wherein the stops comprise shoulders in the sleeve housing.

20. An apparatus according to claim 1 8 additionally comprising latches releasably latching the sleeve in the first position when the sleeve is in the first position and in the second position when the sleeve is in the second position.

21. An apparatus for providing selective access to a lateral bore or a main bore comprising:

a main bore flow conductor in the main bore;

a lateral bore intersecting the main bore;

a lateral bore liner joining the main bore flow conductor and extending into the lateral bore, and a sleeve assembly within the lateral bore liner, the sleeve assembly being operable between a first position wherein the main bore flow conductor is closed, with the sleeve assembly being open into the lateral bore liner, and a second position wherein the sleeve assembly is open into the main bore flow conductor, so that downhole tools select the main bore flow conductor by gravity.

22. An apparatus according to claim 21 wherein the sleeve assembly further comprises:

a sleeve housing including a side window located centrally to and vertically aligned with the main bore flow conductor; and a slidable access selector sleeve movable within the sleeve housing between the first position and the second position.

23. An apparatus according to claim 21 wherein the sleeve assembly includes a selectively openable side window central to and vertically aligned with the main bore flow conductor.

24. An apparatus according to claim 23 wherein the sleeve assembly further comprises an access selector sleeve proximate to and covering the side window, so as to direct downhole tool access to the lateral bore liner.

25. An apparatus according to claim 23 and further comprising:

a slidable access selector sleeve proximate the side window, the access selector sleeve being movable within the sleeve assembly to open the side window and thereby allow access to a distal portion of the main bore flow conductor.

26. Apparatus for providing selective access to a lateral bore and a main bore comprising:

a main well flow conductor in the main bore;

a first window through a sidewall of the main bore flow conductor and opening into the lateral bore;

a lateral bore liner internally engaging the main bore flow conductor above the first window and extending therethrough into the lateral bore, the liner including a second window through the sidewall thereof, the second window being central to, and axially aligned with the main bore flow conductor; and a sleeve assembly within the lateral wellbore liner, the sleeve assembly being movable between a first position wherein the second window is closed so that the sleeve assembly guides downhole tools into the lateral bore liner, and a second position wherein the second window is open, so that downhole tools select the main bore flow conductor by gravity.

27. An apparatus according to claim 26 wherein the sleeve assembly includes a selectively openable window proximate the second window.

28. An apparatus according to claim 27 and further comprising:

a slidable access selector sleeve proximate the second window, the access selector sleeve being movable within the sleeve assembly to open the second window and thereby allow access to a distal portion of the main bore flow conductor.

29. An apparatus according to claim 26 wherein the sleeve assembly further comprising an access selector sleeve proximate to and covering the second window, so as to direct downhole tool access to the lateral bore liner.

30. An apparatus according to claim 26 and further comprising a cemented pressure seal between the window and the liner.

31. An apparatus according to claim 26 wherein the sleeve assembly further comprises:

a sleeve housing including a window substantially matching the second window; and a slidable access selector sleeve movable within the sleeve housing between the first position and the second position.

32. An apparatus for selectively accessing a lateral bore and a main bore flow conductor comprising:

a first window in the main bore flow conductor, the window opening into the lateral bore;

a lateral bore liner internally engaging the main bore flow conductor above the first window and extending therethrough into the lateral bore, the liner including a second window through the sidewall thereof, the second window being central to, and axially aligned with the main bore flow conductor; and a sleeve housing in the lateral bore liner, the sleeve housing having a selectively openable third window corresponding to and in vertical alignment with the second window.

33. An apparatus according to claim 32 and further comprising:

a sleeve within the sleeve housing, proximate the aligned second and third windows, the sleeve being slidable between a first position, wherein the aligned second and third windows are closed and a second position, wherein the aligned second and third windows are unobstructed, so as to allow selection of one of the main well flow conductor and the lateral wellbore liner for access.

34. An apparatus according to claim 32 and further comprising a slidable access selector sleeve proximate to and covering the second window, so as to direct downhole tool access to the liner within the lateral bore.

* * * * *